US011808280B2

(12) United States Patent
Lv et al.

(10) Patent No.: US 11,808,280 B2
(45) Date of Patent: Nov. 7, 2023

(54) CENTRIFUGAL FAN AND CLOTHING DRYER

(71) Applicants: QINGDAO HAIER DRUM WASHING MACHINE CO., LTD., Qingdao (CN); Haier Smart Home Co., Ltd., Qingdao (CN)

(72) Inventors: Peishi Lv, Qingdao (CN); Tao Li, Qingdao (CN); Jindong Bing, Qingdao (CN); Rongfeng Cheng, Qingdao (CN); Long Yang, Qingdao (CN)

(73) Assignees: QINGDAO HAIER DRUM WASHING MACHINE CO., LTD., Qingdao (CN); Haier Smart Home Co., Ltd., Qingdao (CN)

( * ) Notice: Subject to any disclaimer, the term of this patent is extended or adjusted under 35 U.S.C. 154(b) by 198 days.

(21) Appl. No.: 17/613,635

(22) PCT Filed: May 13, 2020

(86) PCT No.: PCT/CN2020/090029

§ 371 (c)(1),
(2) Date: Nov. 23, 2021

(87) PCT Pub. No.: WO2020/233471

PCT Pub. Date: Nov. 26, 2020

(65) Prior Publication Data

US 2022/0228601 A1 Jul. 21, 2022

(30) Foreign Application Priority Data

May 23, 2019 (CN) ..... 201910435945.9

(51) Int. Cl.
*F04D 29/42* (2006.01)
*D06F 58/20* (2006.01)
(Continued)

(52) U.S. Cl.
CPC ..... *F04D 29/4226* (2013.01); *D06F 58/20* (2013.01); *F04D 17/16* (2013.01);
(Continued)

(58) Field of Classification Search
CPC ..... F04D 17/16; F04D 29/281; F04D 29/30; F04D 29/422; F04D 29/4226; F04D 29/424; D06F 58/20
See application file for complete search history.

(56) References Cited

FOREIGN PATENT DOCUMENTS

CN 102758795 A 10/2012
CN 202520657 U 11/2012
(Continued)

OTHER PUBLICATIONS

International Search Report dated Aug. 19, 2020 in corresponding International application No. PCT/CN2020/090029; 6 pages.

*Primary Examiner* — Audrey B. Walter
(74) *Attorney, Agent, or Firm* — Maier & Maier, PLLC

(57) ABSTRACT

A centrifugal fan and a clothing dryer. The centrifugal fan includes a housing as well as an impeller and a worm tongue disposed in the housing. The housing has an air inlet and an air outlet. The volute tongue includes a first volute tongue and a second volute tongue that are stacked and staggered. The first volute tongue cuts the air blown from the impeller and guide the air to the air outlet when the impeller rotates forward. The second volute tongue cuts the air blown from the impeller and guide the air to the air outlet when the impeller rotates backward. When the impeller rotates, the first volute tongue or the second volute tongue can cut the air blown from the impeller and guide the air to the air outlet, so that the centrifugal fan can blow out air when the impeller rotates forward and backward.

14 Claims, 11 Drawing Sheets

(51) Int. Cl.
*F04D 17/16* (2006.01)
*F04D 29/28* (2006.01)
*F04D 29/30* (2006.01)

(52) U.S. Cl.
CPC ..... *F04D 29/281* (2013.01); *F04D 29/30* (2013.01); *F04D 29/422* (2013.01); *F04D 29/424* (2013.01)

(56) References Cited

FOREIGN PATENT DOCUMENTS

| | | | | |
|---|---|---|---|---|
| CN | 104196761 | A | * | 12/2014 |
| CN | 104196761 | A | | 12/2014 |
| CN | 106089805 | A | | 11/2016 |
| CN | 208533192 | U | | 2/2019 |
| CN | 210343751 | U | | 4/2020 |
| JP | 5997657 | A | | 6/1984 |
| JP | H0592100 | A | * | 4/1993 |
| JP | 2011252477 | A | | 12/2011 |

* cited by examiner

CENTRIFUGAL FAN AND CLOTHING DRYER

FIELD

The present disclosure belongs to the technical field of fans, and specifically provides a centrifugal fan and a dryer.

BACKGROUND

Based on the principle of converting kinetic energy into potential energy, a centrifugal fan uses a high-speed rotating impeller to accelerate gas, then decelerate it, and change a flow direction thereof, thus converting kinetic energy into potential energy. The centrifugal fan includes a motor, a housing, and an impeller arranged in the housing. The motor can drive the impeller to rotate at a high speed to accelerate the gas. A volute tongue is provided at an air outlet of the housing, and the volute tongue can cut an air flow driven by the impeller so that the air flow is discharged from the air outlet.

In some occasions, the centrifugal fan is required to be able to achieve both forward and reverse rotations. Taking dryers as an example, in order to reduce the cost, existing dryers usually use one motor to simultaneously drive a drying cylinder and the impeller of the centrifugal fan to rotate. In order to solve the problem of entangled clothing in the drying cylinder, the drying cylinder needs to rotate in both forward and reverse directions during the working process of the dryer. When the impeller rotates in the forward direction as the drying cylinder rotates in the forward direction (which is the design direction of the centrifugal fan), the volute tongue can cut the air flow driven by the impeller so that the air flow is discharged from the air outlet. However, when the impeller rotates in the reverse direction as the drying cylinder rotates in the reverse direction (which is opposite to the design direction), the volute tongue cannot cut the air flow driven by the impeller, resulting in a sharp decrease in the air volume discharged from the air outlet, thereby affecting a drying effect on the clothing.

Accordingly, there is a need in the art for a new centrifugal fan and dryer to solve the above problem.

SUMMARY

In order to solve the above problem in the prior art, that is, to solve the problem that the volute tongue of the existing centrifugal fan cannot cut the air flow driven by the impeller when the rotation direction of the impeller is opposite to the design direction, which results in a sharp decrease in the air volume discharged from the centrifugal fan, the present disclosure provides a centrifugal fan, which includes a housing, as well as an impeller and volute tongues that are arranged in the housing, in which the housing is provided with an air inlet and an air outlet, the volute tongues include a first volute tongue and a second volute tongue that are stacked and offset from each other, and the impeller is arranged to be capable of suctioning air into the housing from the air inlet when rotating; the first volute tongue is arranged to be capable of cutting the air blown from the impeller and guiding the air to the air outlet when the impeller is rotating in a forward direction, and the second volute tongue is arranged to be capable of cutting the air blown from the impeller and guiding the air to the air outlet when the impeller is rotating in a reverse direction.

In a preferred technical solution of the above centrifugal fan, the impeller is a double-layer impeller which includes a first-layer impeller portion corresponding to the first volute tongue and a second-layer impeller portion corresponding to the second volute tongue, an axis of the first-layer impeller portion coinciding with an axis of the second-layer impeller portion.

In a preferred technical solution of the above centrifugal fan, the first-layer impeller portion includes a plurality of first vanes arranged annularly, which are collectively arranged to be capable of guiding air entering the housing from the air inlet to the first volute tongue when the first-layer impeller portion is rotating in the forward direction; and the second-layer impeller portion includes a plurality of second vanes arranged annularly, which are collectively arranged to be capable of guiding the air entering the housing from the air inlet to the second volute tongue when the second-layer impeller portion is rotating in the reverse direction.

In a preferred technical solution of the above centrifugal fan, the first vanes and the second vanes are all arc-shaped vanes, and an inclination direction of the first vanes is different from an inclination direction of the second vanes.

In a preferred technical solution of the above centrifugal fan, the first vanes and the second vanes are all straight vanes, and an inclination direction of the first vanes is the same as or different from an inclination direction of the second vanes.

In a preferred technical solution of the above centrifugal fan, the impeller is a single-layer impeller which includes an impeller portion corresponding to the first volute tongue and the second volute tongue, and the impeller portion includes a plurality of vanes arranged annularly, which are collectively arranged to be capable of guiding air entering the housing from the air inlet to the first volute tongue and the second volute tongue when the impeller portion rotates either in the forward direction or in the reverse direction.

In a preferred technical solution of the above centrifugal fan, the plurality of vanes are all straight vanes and arranged in a radial direction of the single-layer impeller.

In a preferred technical solution of the above centrifugal fan, the number of the air inlet is one, and the air inlet is provided on one side of the housing.

In a preferred technical solution of the above centrifugal fan, an air guiding structure is provided in the impeller, and the air guiding structure is arranged to be capable of guiding the air entering the housing.

In a preferred technical solution of the above centrifugal fan, the air guiding structure is an air guiding frustum, and a cone end of the air guiding frustum is arranged close to the air inlet.

In a preferred technical solution of the above centrifugal fan, the number of the air inlet is two, and the air inlets include a first air inlet and a second air inlet which are respectively arranged on both sides of the housing.

In a preferred technical solution of the above centrifugal fan, an air guiding structure is provided in the impeller, and the air guiding structure is arranged to be capable of guiding the air entering the housing.

In a preferred technical solution of the above centrifugal fan, the air guiding structure includes a first air guiding frustum and a second air guiding frustum that are connected, in which a cone end of the first air guiding frustum is arranged close to the first air inlet, and a cone end of the second air guiding frustum is arranged close to the second air inlet.

In another aspect, the present disclosure also provides a dryer, which includes the centrifugal fan described above.

It can be understood by those skilled in the art that in the preferred technical solutions of the present disclosure, two volute tongue structures are provided in the housing of the centrifugal fan: a first volute tongue and a second volute tongue, and the first volute tongue and the second volute tongue are stacked and offset from each other. For example, the first volute tongue is arranged on a left-side plate of the housing and close to a top plate of the housing, and the second volute tongue is arranged on a right-side plate of the housing and close to a bottom plate of the housing. When the impeller rotates in the forward direction, the first volute tongue can cut the air blown from an upper half of the impeller and guide the air to the air outlet, and when the impeller rotates in the reverse direction, the second worm tongue can cut the air blown from a lower half of the impeller and guide the air to the air outlet. Through such an arrangement, the centrifugal fan can blow out a large amount of air when the impeller rotates either in the forward direction or in the reverse direction.

Further, the impeller is a double-layer impeller. The double-layer impeller includes a first-layer impeller portion and a second-layer impeller portion. The first-layer impeller portion corresponds to the first volute tongue, and the second-layer impeller portion corresponds to the second volute tongue. Through such an arrangement, the specific form of the vanes of the first-layer impeller portion and the specific form of the vanes of the second-layer impeller portion can be flexibly set in actual applications according to actual needs, and the design is more flexible and diversified, thereby enabling the centrifugal fan to meet more different requirements.

Further, when the first-layer impeller portion rotates in the forward direction, the first vanes can guide the air entering the housing from the air inlet to the first volute tongue, which can therefore increase the air volume discharged from the centrifugal fan. Similarly, when the second-layer impeller portion rotates in the reverse direction, the second vanes can guide the air entering the housing from the air inlet to the second volute tongue, which can therefore increase the air volume discharged from the centrifugal fan. That is, the air volume discharged from the centrifugal fan can be increased when the impeller rotates either in the forward direction or in the reverse direction.

Further, the impeller is a single-layer impeller which includes an impeller portion corresponding to the first volute tongue and the second volute tongue, and the impeller portion includes a plurality of vanes arranged annularly. By setting the impeller as a single-layer impeller, the design difficulty can be reduced, the processing is facilitated, and the cost is reduced.

Further, the plurality of vanes are all straight vanes and arranged in the radial direction of the single-layer impeller. Through such an arrangement, the centrifugal fan can blow out the same amount of air when the impeller rotates either in the forward direction or in the reverse direction.

Further, an air guiding structure is provided in the impeller. The air guiding structure guides the air entering the housing, which is advantageous for the flow of air.

Further, the air inlet includes a first air inlet and a second air inlet, which are respectively provided on both sides of the housing. By arranging the two air inlets, air can enter from both sides of the housing at the same time, so that the air volume discharged from the centrifugal fan can be increased.

Further, in a case where the number of the air inlet is two, the air guiding structure includes a first air guiding frustum and a second air guiding frustum that are connected, with a cone end of the first air guiding frustum being arranged close to the first air inlet, and a cone end of the second air guiding frustum being arranged close to the second air inlet. The first air guiding frustum guides the air entering from the first air inlet, and the second air guiding frustum guides the air entering from the second air inlet, which can avoid air collision and turbulence in the impeller. Specifically, in the structure of the double-layer impeller, the first air guiding frustum guides the air entering from the first air inlet to the first impeller portion, and the second air guiding frustum guides the air entering from the second air inlet to the second impeller portion, which can avoid air collision in the impeller. In the single-layer impeller structure, the first air guiding frustum guides the air entering from the first air inlet to the upper half of the impeller portion, and the second air guiding frustum guides the air entering from the second air inlet to the lower half of the impeller portion, which can avoid air collision in the impeller.

In addition, the dryer further provided by the present disclosure on the basis of the above technical solutions, due to the employment of the above centrifugal fan, has the technical effects of the above centrifugal fan. As compared with the dryer before improvement, the dryer of the present disclosure can provide a sufficient amount of air when the drying cylinder rotates either in the forward direction or in the reverse direction, thereby improving the drying effect on the clothing.

BRIEF DESCRIPTION OF DRAWINGS

Preferred embodiments of the present disclosure will be described below with reference to the accompanying drawings, in which.

DETAILED DESCRIPTION

Figure 1:
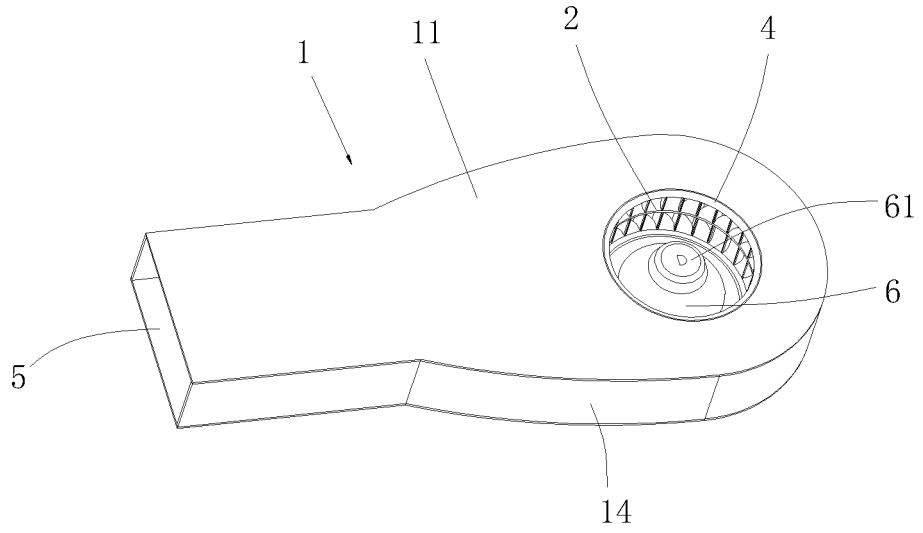
FIG. 1 is a first schematic structural view of a first embodiment of a centrifugal fan of the present disclosure.

First, it should be understood by those skilled in the art that the embodiments described below are only used to explain the technical principles of the present disclosure, and are not intended to limit the scope of protection of the present disclosure.

It should be noted that in the description of the present disclosure, terms indicating directional or positional relationships, such as "upper", "lower", "left", "right", "top", "bottom", "inner", "outer", "clockwise", "counterclockwise" and the like, are based on the directional or positional relationships shown in the accompanying drawings. They are only used for ease of description, and do not indicate or imply that the device or element must have a specific orientation, or be constructed or operated in a specific orientation. Therefore, they should not be considered as limitations to the present disclosure. In addition, terms "first" and "second" are merely used for description, and should not be construed as indicating or implying relative importance.

In addition, it should also be noted that in the description of the present disclosure, unless otherwise clearly specified and defined, terms "install", "arrange", "connect" and "connection" should be understood in a broad sense; for example, the connection may be a fixed connection, or may also be a detachable connection, or an integral connection; it may be a mechanical connection, or an electrical connection; it may be a direct connection, or an indirect connection implemented through an intermediate medium, or it may be an internal communication between two elements. For those skilled in the art, the specific meaning of the above terms in the present disclosure can be understood according to specific situations.

Based on the problem pointed out in the "BACKGROUND" that the volute tongue of the existing centrifugal fan cannot cut the air flow driven by the impeller when the rotation direction of the impeller is opposite to the design direction, which results in a sharp decrease in the air volume discharged from the centrifugal fan, the present disclosure provides a centrifugal fan and a dryer, aiming at enabling the volute tongue of the centrifugal fan to cut the air flow driven by the impeller when the impeller rotates either in the forward direction or in the reverse direction and guaranteeing the demand on the air volume.

Specifically, the centrifugal fan of the present disclosure includes a housing, as well as an impeller and volute tongues that are arranged in the housing, in which the housing is provided with an air inlet and an air outlet, the volute tongues include a first volute tongue and a second volute tongue that are stacked and offset from each other, and the impeller is arranged to be capable of suctioning air into the housing from the air inlet when rotating; the first volute tongue is arranged to be capable of cutting the air blown from the impeller and guiding the air to the air outlet when the impeller is rotating in a forward direction, and the second volute tongue is arranged to be capable of cutting the air blown from the impeller and guiding the air to the air outlet when the impeller is rotating in a reverse direction. That is, in the present disclosure, two volute tongue structures are provided in the housing of the centrifugal fan: a first volute tongue and a second volute tongue, and the first volute tongue and the second volute tongue are arranged in a layered and staggered manner For example, the first volute tongue is arranged on a left-side plate of the housing and close to a top plate of the housing, and the second volute tongue is arranged on a right-side plate of the housing and close to a bottom plate of the housing. When the impeller rotates in the forward direction, the first volute tongue can cut the air blown from an upper half of the impeller and guide the air to the air outlet, and when the impeller rotates in the reverse direction, the second worm tongue can cut the air blown from a lower half of the impeller and guide the air to the air outlet. Through such an arrangement, the centrifugal fan can blow out a large amount of air when the impeller rotates either in the forward direction or in the reverse direction. The technical solutions of the present disclosure will be described in detail below in conjunction with specific embodiments.

First Embodiment

Figure 2:
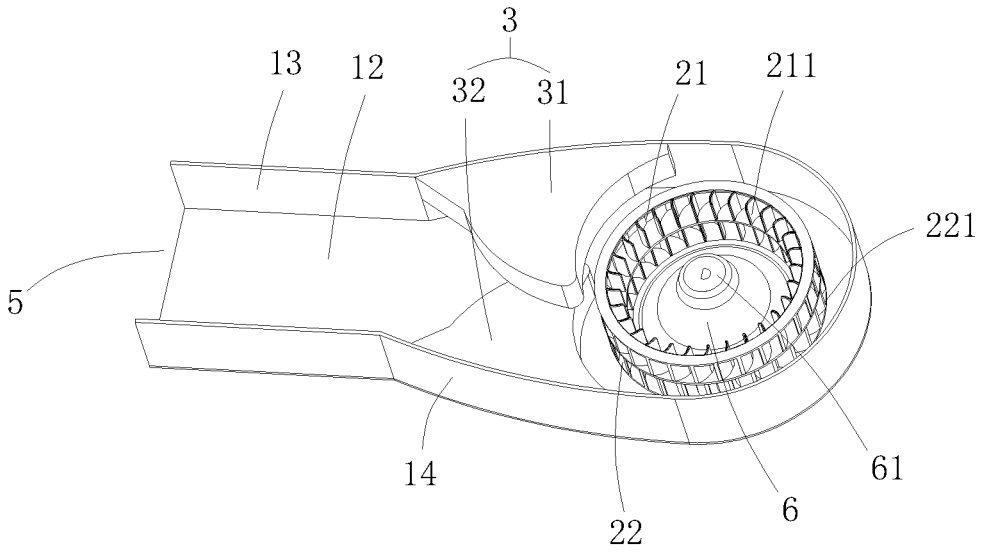
FIG. 2 is a second schematic structural view of the first embodiment of the centrifugal fan of the present disclosure.
Figure 3:
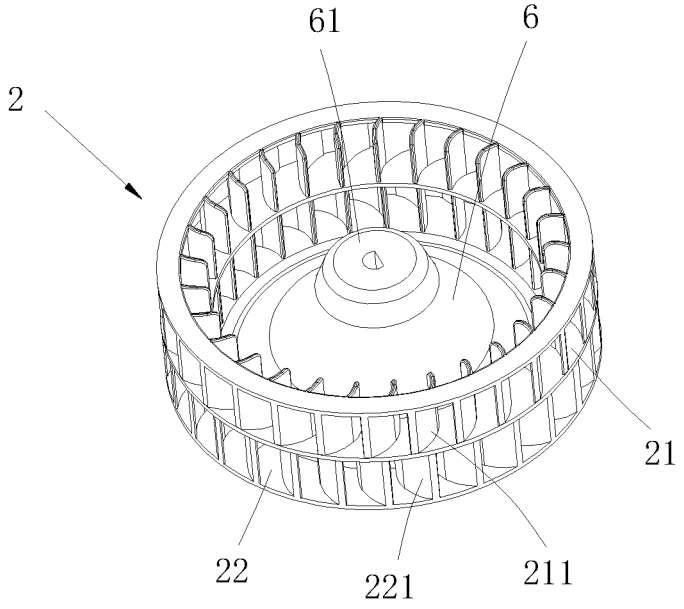
FIG. 3 is a first schematic structural view of an impeller of the first embodiment of the centrifugal fan of the present disclosure.
Figure 4:
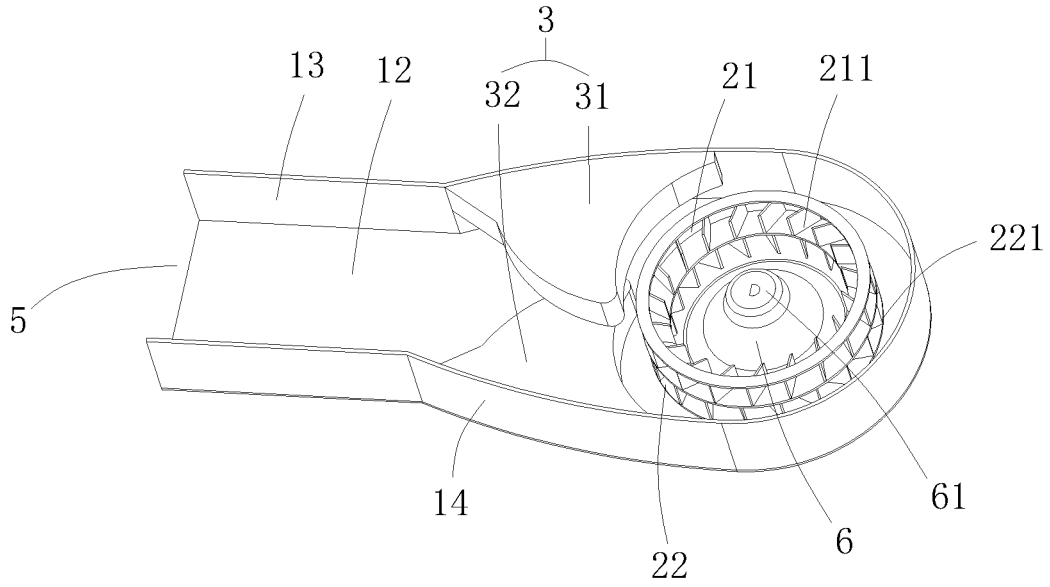
FIG. 4 is a third schematic structural view of the first embodiment of the centrifugal fan of the present disclosure.

In the following, the technical solution of the first embodiment of the present disclosure will be described with reference to FIGS. 1 to 5, in which FIG. 1 is a first schematic structural view of the first embodiment of the centrifugal fan of the present disclosure; FIG. 2 is a second schematic structural view of the first embodiment of the centrifugal fan of the present disclosure; FIG. 3 is a first schematic structural view of an impeller of the first embodiment of the centrifugal fan of the present disclosure; FIG. 4 is a third schematic structural view of the first embodiment of the centrifugal fan of the present disclosure; and FIG. 5 is a second schematic structural view of the impeller of the first embodiment of the centrifugal fan of the present disclosure.

As shown in FIGS. 1 and 2, the centrifugal fan of this embodiment includes a housing 1, as well as an impeller 2 and volute tongues 3 that are arranged in the housing 1. The housing 1 is provided with an air inlet 4 and an air outlet 5. The volute tongues 3 include a first volute tongue 31 and a second volute tongue 32 that are stacked and offset from each other. The impeller 2 is a double-layer impeller which includes a first-layer impeller portion 21 corresponding to the first volute tongue 31 and a second-layer impeller portion 22 corresponding to the second volute tongue 32, an axis of the first-layer impeller portion 21 coinciding with an axis of the second-layer impeller portion 22. The number of the air inlet 4 is one, and the air inlet 4 is arranged on a top plate 11 of the housing 1. Of course, the air inlet 4 may also be arranged on a bottom plate 12 of the housing 1. The first volute tongue 31 is arranged at an upper part of a left-side plate 13 of the housing 1, that is, arranged close to the top plate 11, and the second volute tongue 32 is arranged at a lower part of a right-side plate 14 of the housing 1, that is, arranged close to the bottom plate 12. When the impeller 2 is rotating in the forward direction (rotating clockwise when viewed from the figure), the first volute tongue 31 can cut the air blown from the first-layer impeller portion 21 and guide the air to the air outlet 5, and when the impeller 2 is rotating in the reverse direction (rotating counterclockwise when viewed from the figure), the second volute tongue 32 can cut the air blown from the second-layer impeller portion 22 and guide the air to the air outlet 5.

Figure 5:
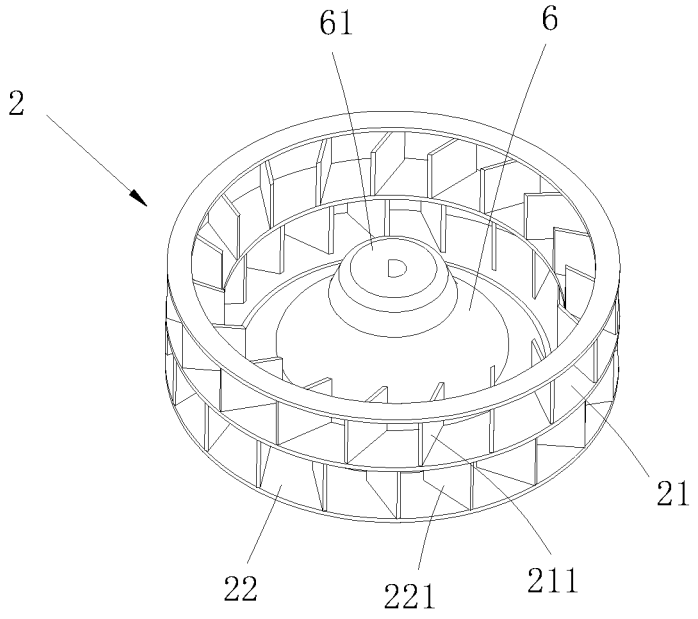
FIG. 5 is a second schematic structural view of the impeller of the first embodiment of the centrifugal fan of the present disclosure.

Preferably, as shown in FIGS. 2 to 5, the first-layer impeller portion 21 includes a plurality of first vanes 211 arranged annularly, which are collectively arranged to be capable of guiding the air entering the housing 1 from the air inlet 4 to the first volute tongue 31 when the first-layer impeller portion 21 is rotating in the forward direction; and the second-layer impeller portion 22 includes a plurality of second vanes 221 arranged annularly, which are collectively arranged to be capable of guiding the air entering the housing 1 from the air inlet 4 to the second volute tongue 32 when the second-layer impeller portion 22 is rotating in the reverse direction. In a preferred situation, as shown in FIGS. 2 and 3, the first vanes 211 and the second vanes 221 are all arc-shaped vanes. When the first-layer impeller portion 21 rotates in the forward direction (rotating clockwise when viewed from the figure), since the first vanes 211 are inclined clockwise, the first vanes 211 can guide the air entering the housing 1 from the air inlet 4 to the first volute tongue 31. Similarly, when the second-layer impeller portion 22 rotates in the reverse direction (rotating counterclockwise when viewed from the figure), since the second vanes 221 are inclined counterclockwise, the second vanes 221 can guide the air entering the housing 1 from the air inlet 4 to the second volute tongue 32. An inclination direction of the first vanes 211 is different from an inclination direction of the second vanes 221. In another preferred situation, as shown in FIGS. 4 and 5, the first vanes 211 and the second vanes 221 are all straight vanes. When the first-layer impeller portion 21 rotates in the forward direction (rotating clockwise when viewed from the figure), since the first vanes 211 are inclined clockwise, the first vanes 211 can guide the air entering the housing 1 from the air inlet 4 to the first volute tongue 31. Similarly, when the second-layer impeller portion 22 rotates in the reverse direction (rotating counterclockwise when viewed from the figure), since the second vanes 221 are inclined counterclockwise, the second vanes 221 can guide the air entering the housing 1 from the air inlet 4 to the second volute tongue 32. The inclination direction of the first vanes 211 is different from the inclination direction of the second vanes 221. In another special preferred situation, the first vanes 211 and the second vanes 221 are all straight vanes, and the first vanes 211 and the second vanes 221 are all arranged in the radial direction of the impeller 2. In this special situation, the inclination direction of the first vanes 211 is the same as the inclination direction of the second vanes 221. It should be noted that these above several situations are only preferred situations. The first vanes 211 and the second vanes 221 may also be configured into other shapes. For example, the first vanes 211 and the second vanes 221 may also be provided as "V"-shaped vanes or "L"-shaped vanes, etc. Such flexible adjustments and changes do not deviate from the principle and scope of the present disclosure, and should be defined within the scope of protection of the present disclosure.

Preferably, as shown in FIGS. 1 and 2, an air guiding structure 6 is provided in the impeller 2, and the air guiding structure 6 is arranged to be capable of guiding the air entering the housing 1. The air guiding structure 6 is an air guiding frustum 6, and a cone end 61 of the air guiding frustum 6 is arranged close to the air inlet 4. The air enters from the air inlet 4 and then flows to the first-layer impeller portion 21 and the second-layer impeller portion 22 under the guidance of the air guiding frustum 6. Of course, the air guiding structure 6 may also be provided as other air guiding structures such as a triangular pyramid. Such adjustments and changes to the specific structural form of the air guiding structure 6 do not deviate from the principle and scope of the present disclosure, and should be defined within the scope of protection of the present disclosure.

Second Embodiment

Figure 6:
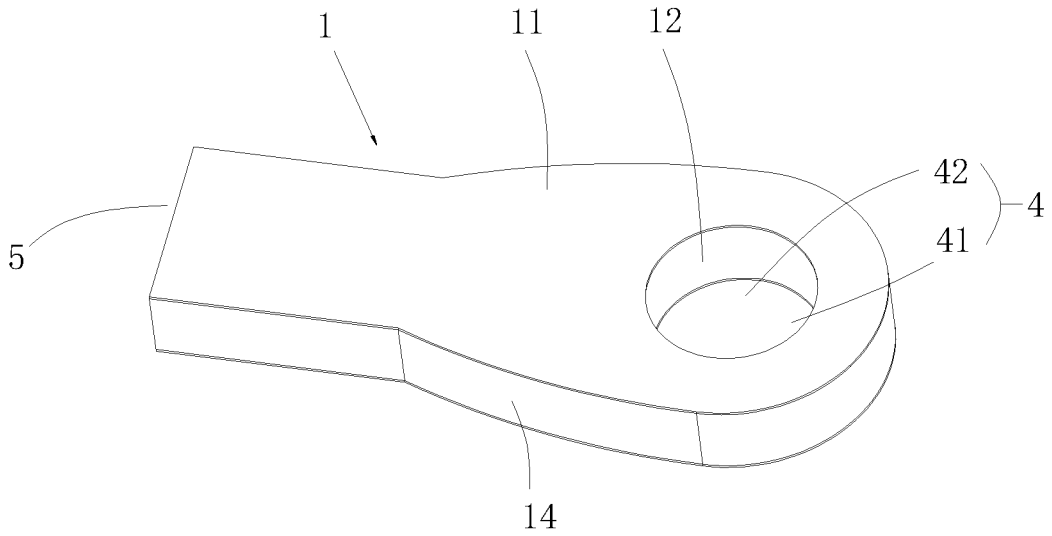
FIG. 6 is a schematic structural view of a housing of a second embodiment of the centrifugal fan of the present disclosure.
Figure 7:
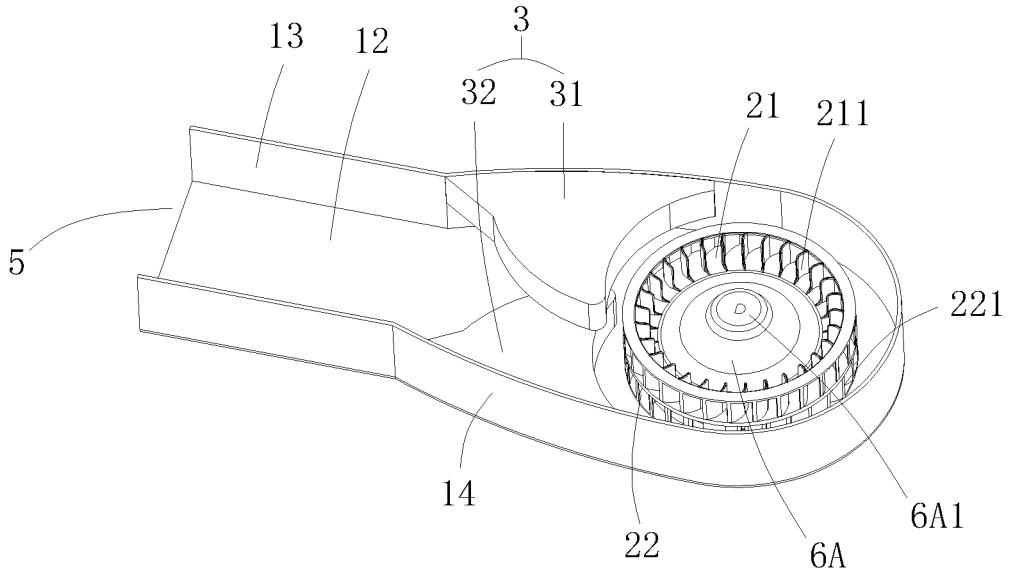
FIG. 7 is a first schematic structural view of the second embodiment of the centrifugal fan of the present disclosure.
Figure 8:
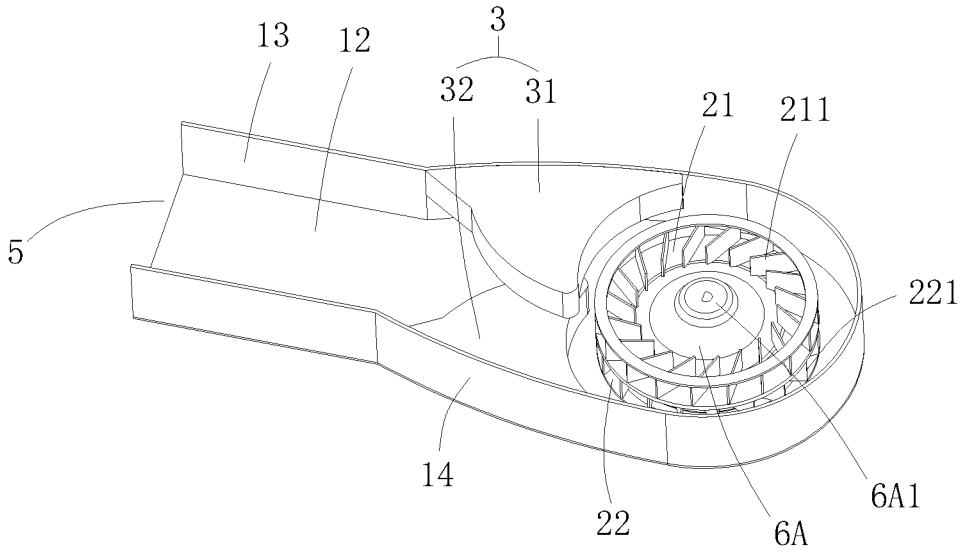
FIG. 8 is a second schematic structural view of the second embodiment of the centrifugal fan of the present disclosure.
Figure 9:
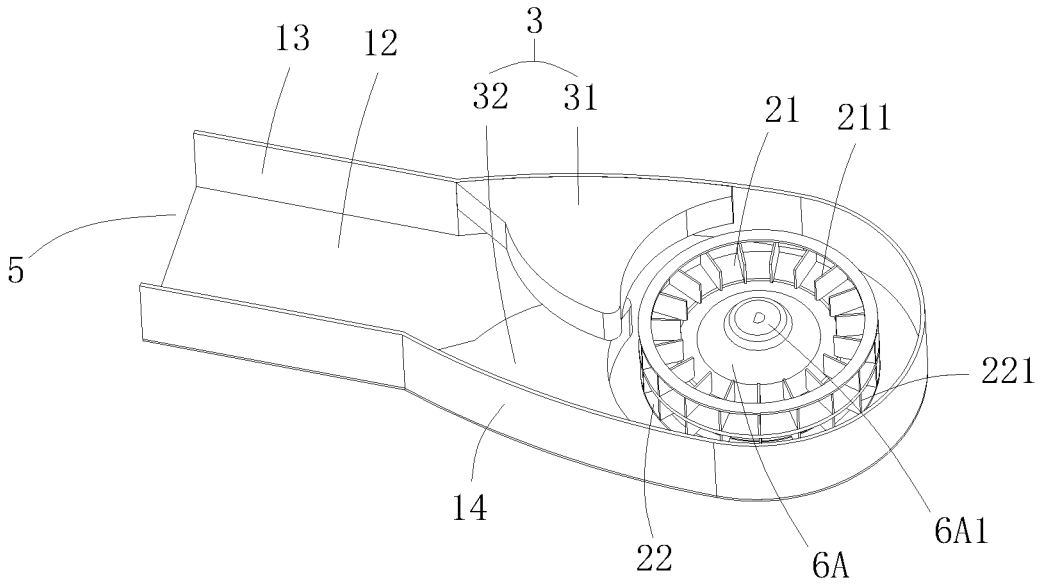
FIG. 9 is a third schematic structural view of the second embodiment of the centrifugal fan of the present disclosure.
Figure 10:
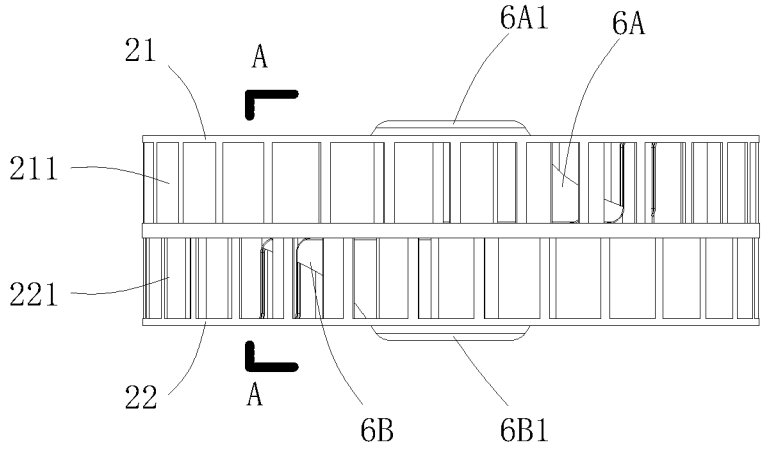
FIG. 10 is a schematic structural view of the impeller of the second embodiment of the centrifugal fan of the present disclosure.
Figure 11:
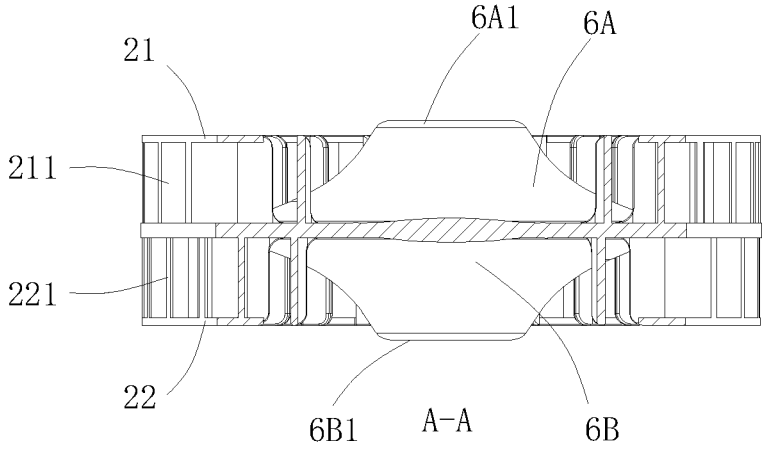
FIG. 11 is a cross-sectional view of FIG. 10.

In the following, the technical solution of the second embodiment of the present disclosure will be described with reference to FIGS. 6 to 11, in which FIG. 6 is a schematic structural view of a housing of the second embodiment of the centrifugal fan of the present disclosure; FIG. 7 is a first schematic structural view of the second embodiment of the centrifugal fan of the present disclosure; FIG. 8 is a second schematic structural view of the second embodiment of the centrifugal fan of the present disclosure; FIG. 9 is a third schematic structural view of the second embodiment of the centrifugal fan of the present disclosure; FIG. 10 is a schematic structural view of the impeller of the second embodiment of the centrifugal fan of the present disclosure; and FIG. 11 is a cross-sectional view of FIG. 10.

As shown in FIGS. 6 to 9, the centrifugal fan of this embodiment includes a housing 1, as well as an impeller 2 and volute tongues 3 that are arranged in the housing 1. The housing 1 is provided with air inlets 4 and an air outlet 5. The volute tongues 3 include a first volute tongue 31 and a second volute tongue 32 that are stacked and offset from each other. The impeller 2 is a double-layer impeller which includes a first-layer impeller portion 21 corresponding to the first volute tongue 31 and a second-layer impeller portion 22 corresponding to the second volute tongue 32, an axis of the first-layer impeller portion 21 coinciding with an axis of the second-layer impeller portion 22. The number of the air inlets 4 is two, and the air inlets 4 include a first air inlet 41 and a second air inlet 42. The first air inlet 41 and the second air inlet 42 are respectively provided on both sides of the housing 1, the first air inlet 41 may be provided on the top plate 11 of the housing 1, and the second air inlet 42 may be provided on the bottom plate 12 of the housing 1. The first volute tongue 31 is arranged at an upper part of the left-side plate 13 of the housing 1, that is, arranged close to the top plate 11, and the second volute tongue 32 is arranged at a lower part of the right-side plate 14 of the housing 1, that is, arranged close to the bottom plate 12. When the impeller 2 is rotating in the forward direction (rotating clockwise when viewed from the figure), the first volute tongue 31 can cut the air blown from the first-layer impeller portion 21 and guide the air to the air outlet 5, and when the impeller 2 is rotating in the reverse direction (rotating counterclockwise when viewed from the figure), the second volute tongue 32 can cut the air blown from the second-layer impeller portion 22 and guide the air to the air outlet 5.

It should be noted that in a case where two air inlets 4 are provided, an output shaft of a driving motor (not shown in the figure) used to drive the impeller 2 to rotate may extend from the first air inlet 41 or the second air inlet 42 so as to be connected connect with the impeller 2. If the output shaft of the driving motor extends from the first air inlet 41, it is necessary to set a gap between the driving motor and the first air inlet 41 to avoid impeding the air from entering the housing 1 from the first air inlet 41. Similarly, if the output shaft of the driving motor extends from the second air inlet 42, it is necessary to set a gap between the driving motor and the second air inlet 42 to avoid impeding the air from entering the housing 1 from the second air inlet 42.

Preferably, as shown in FIGS. 7 to 9, similar to the first embodiment, in this embodiment, the first-layer impeller portion 21 includes a plurality of first vanes 211 arranged annularly, which are collectively arranged to be capable of guiding the air entering the housing 1 from the air inlet 4 to the first volute tongue 31 when the first-layer impeller portion 21 is rotating in the forward direction; and the second-layer impeller portion 22 includes a plurality of second vanes 221 arranged annularly, which are collectively arranged to be capable of guiding the air entering the housing 1 from the air inlet 4 to the second volute tongue 32 when the second-layer impeller portion 22 is rotating in the reverse direction. In a preferred situation, as shown in FIG. 7, the first vanes 211 and the second vanes 221 are all arc-shaped vanes. When the first-layer impeller portion 21 rotates in the forward direction (rotating clockwise when viewed from the figure), since the first vanes 211 are inclined clockwise, the first vanes 211 can guide the air entering the housing 1 from the air inlet 4 to the first volute tongue 31. Similarly, when the second-layer impeller portion 22 rotates in the reverse direction (rotating counterclockwise when viewed from the figure), since the second vanes 221 are inclined counterclockwise, the second vanes 221 can guide the air entering the housing 1 from the air inlet 4 to the second volute tongue 32. An inclination direction of the first vanes 211 is different from an inclination direction of the second vanes 221. In another preferred situation, as shown in FIG. 8, the first vanes 211 and the second vanes 221 are all straight vanes. When the first-layer impeller portion 21 rotates in the forward direction (rotating clockwise when viewed from the figure), since the first vanes 211 are inclined clockwise, the first vanes 211 can guide the air entering the housing 1 from the air inlet 4 to the first volute tongue 31. Similarly, when the second-layer impeller portion 22 rotates in the reverse direction (rotating counterclockwise when viewed from the figure), since the second vanes 221 are inclined counterclockwise, the second vanes 221 can guide the air entering the housing 1 from the air inlet 4 to the second volute tongue 32. The inclination direction of the first vanes 211 is different from the inclination direction of the second vanes 221. In another special preferred situation, as shown in FIG. 9, the first vanes 211 and the second vanes 221 are all straight vanes, and the first vanes 211 and the second vanes 221 are all arranged in the radial direction of the impeller 2. In this special situation, the inclination direction of the first vanes 211 is the same as the inclination direction of the second vanes 221. It should be noted that these above several situations are only preferred situations. The first vanes 211 and the second vanes 221 may also be configured into other shapes. For example, the first vanes 211 and the second vanes 221 may also be provided as "V"-shaped vanes or "L"-shaped vanes, etc. Such flexible adjustments and changes do not deviate from the principle and scope of the present disclosure, and should be defined within the scope of protection of the present disclosure.

Preferably, as shown in FIGS. 6 to 11, an air guiding structure 6 is provided in the impeller 2, and the air guiding structure 6 is arranged to be capable of guiding the air entering the housing 1. The air guiding structure 6 includes a first air guiding frustum 6A and a second air guiding frustum 6B that are connected, with a cone end 6A1 of the first air guiding frustum 6A being arranged close to the first air inlet 41, and a cone end 6B1 of the second air guiding frustum 6B being arranged close to the second air inlet 42. The air enters from the first air inlet 41 and then flows to the first-layer impeller portion 21 under the guidance of the first air guiding frustum 6A, and the air enters from the second air inlet 42 and then flows to the second-layer impeller portion 22 under the guidance of the second air guiding frustum 6B. Of course, the air guiding structure 6 may also be provided as other air guiding structures such as two triangular pyramids connected. Such adjustments and changes to the specific structural form of the air guiding structure 6 do not deviate from the principle and scope of the present disclosure, and should be defined within the scope of protection of the present disclosure.

Third Embodiment

Figure 12:
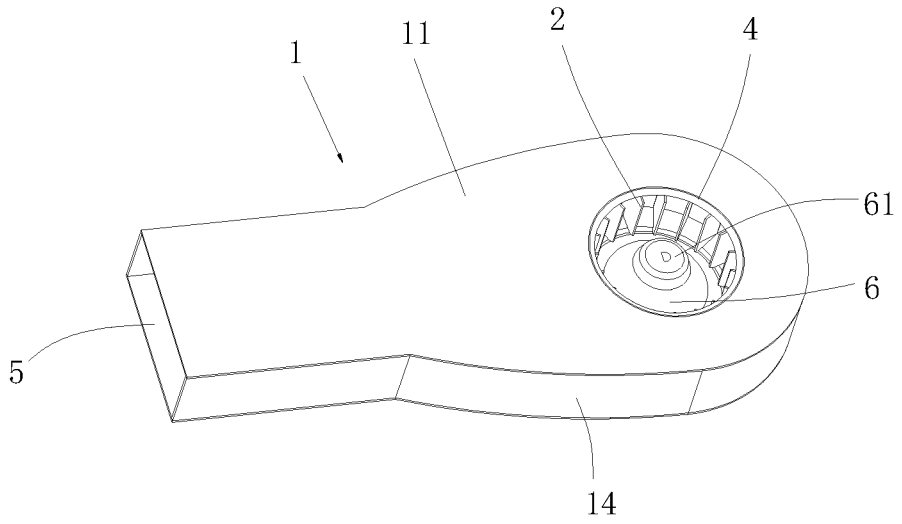
FIG. 12 is a first schematic structural view of a third embodiment of the centrifugal fan of the present disclosure.
Figure 13:
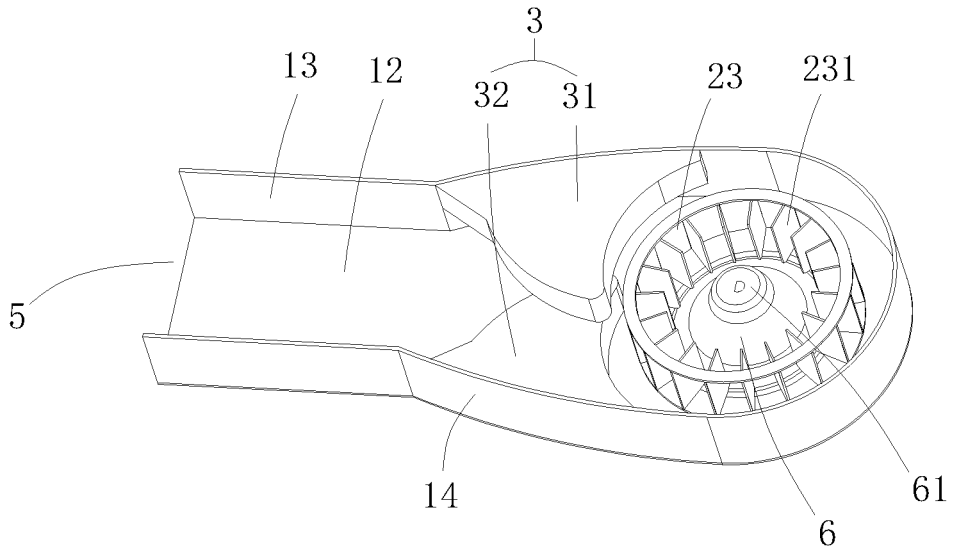
FIG. 13 is a second schematic structural view of the third embodiment of the centrifugal fan of the present disclosure.
Figure 14:
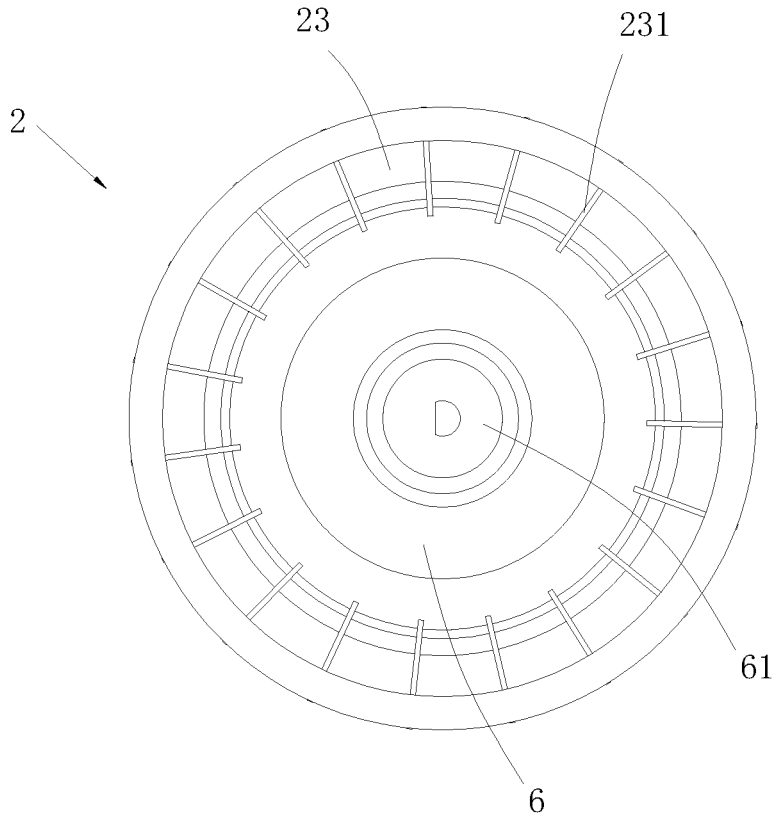
FIG. 14 is a first schematic structural view of the impeller of the third embodiment of the centrifugal fan of the present disclosure.
Figure 15:
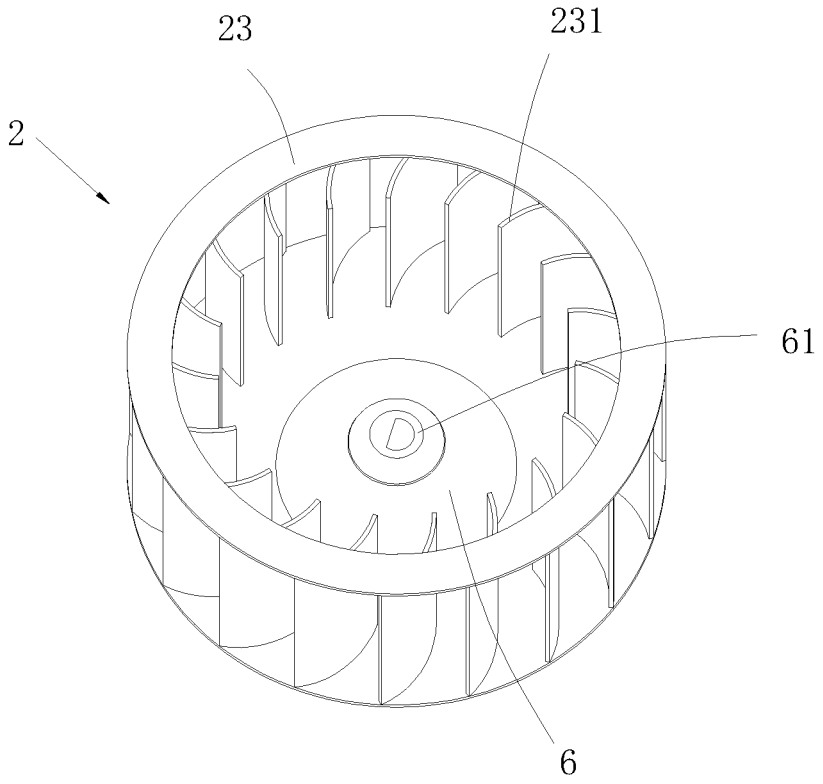
FIG. 15 is a second schematic structural view of the impeller of the third embodiment of the centrifugal fan of the present disclosure.

In the following, the technical solution of the third embodiment of the present disclosure will be described with reference to FIGS. 12 to 15, in which FIG. 12 is a first schematic structural view of the third embodiment of the centrifugal fan of the present disclosure; FIG. 13 is a second schematic structural view of the third embodiment of the centrifugal fan of the present disclosure; FIG. 14 is a first schematic structural view of the impeller of the third embodiment of the centrifugal fan of the present disclosure; and FIG. 15 is a second schematic structural view of the impeller of the third embodiment of the centrifugal fan of the present disclosure.

As shown in FIGS. 12 to 14, the centrifugal fan of this embodiment includes a housing 1, as well as an impeller 2 and volute tongues 3 that are arranged in the housing 1. The housing 1 is provided with an air inlet 4 and an air outlet 5. The volute tongues 3 include a first volute tongue 31 and a second volute tongue 32 that are stacked and offset from each other. The impeller 2 is a single-layer impeller which includes an impeller portion 23 corresponding to the first volute tongue 31 and the second volute tongue 32, and the impeller portion 23 includes a plurality of vanes 231 arranged annularly, which are collectively arranged to be capable of guiding air entering the housing 1 from the air inlet 4 to the first volute tongue 31 and the second volute tongue 32 when the impeller portion 23 rotates either in the forward direction or in the reverse direction. The air inlet 4 is arranged on the top plate 11 of the housing 1. Of course, the air inlet 4 may also be arranged on the bottom plate 12 of the housing 1. The first volute tongue 31 is arranged at an upper part of the left-side plate 13 of the housing 1, that is, arranged close to the top plate 11, and the second volute tongue 32 is arranged at a lower part of the right-side plate 14 of the housing 1, that is, arranged close to the bottom plate 12. When the impeller 2 is rotating in the forward direction (rotating clockwise when viewed from the figure), the first volute tongue 31 can cut the air blown from an upper half of the impeller portion 23 and guide the air to the air outlet 5, and when the impeller 2 is rotating in the reverse direction (rotating counterclockwise when viewed from the figure), the second volute tongue 32 can cut the air blown from a lower half of the impeller portion 23 and guide the air to the air outlet 5.

Preferably, as shown in FIGS. 13 and 14, the plurality of vanes 231 are all straight vanes and are arranged in the radial direction of the single-layer impeller. Through such an arrangement, the centrifugal fan can blow out the same amount of air when the impeller 2 rotates either in the forward direction or in the reverse direction. Of course, the vanes 231 may also be set to form a specific angle with the radial direction of the single-layer impeller, or the vanes 231 may be configured into other shapes. For example, the vanes 231 may be provided as arc-shaped vanes (just as shown in FIG. 15), "V"-shaped vanes or "L"-shaped vanes, etc. Such flexible adjustments and changes do not deviate from the principle and scope of the present disclosure, and should be defined within the scope of protection of the present disclosure.

Preferably, as shown in FIGS. 12 and 13, an air guiding structure 6 is provided in the impeller 2, and the air guiding structure 6 is arranged to be capable of guiding the air entering the housing 1. The air guiding structure 6 is an air guiding frustum 6, and a cone end 61 of the air guiding frustum 6 is arranged close to the air inlet 4. The air enters from the air inlet 4 and then flows to the impeller portion 23 under the guidance of the air guiding frustum 6. Of course, the air guiding structure 6 may also be provided as other air guiding structures such as a triangular pyramid. Such adjustments and changes to the specific structural form of the air guiding structure 6 do not deviate from the principle and scope of the present disclosure, and should be defined within the scope of protection of the present disclosure.

Fourth Embodiment

Figure 16:
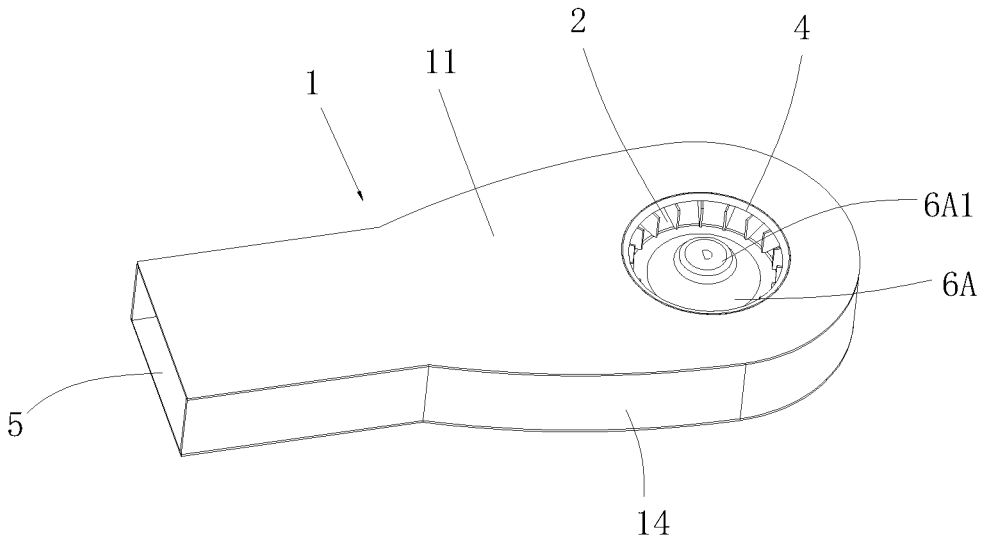
FIG. 16 is a first schematic structural view of a fourth embodiment of the centrifugal fan of the present disclosure.
Figure 17:
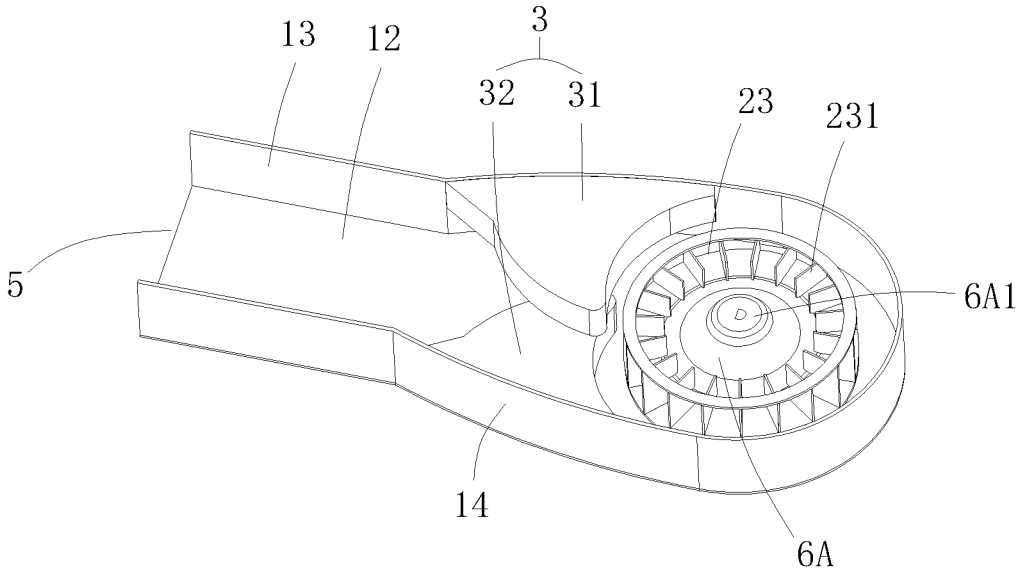
FIG. 17 is a second schematic structural view of the fourth embodiment of the centrifugal fan of the present disclosure.
Figure 18:
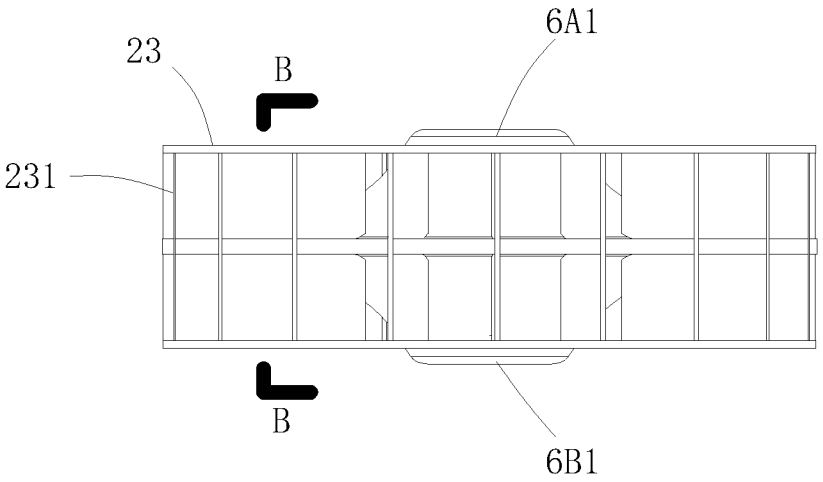
FIG. 18 is a schematic structural view of the impeller of the fourth embodiment of the centrifugal fan of the present disclosure.
Figure 19:
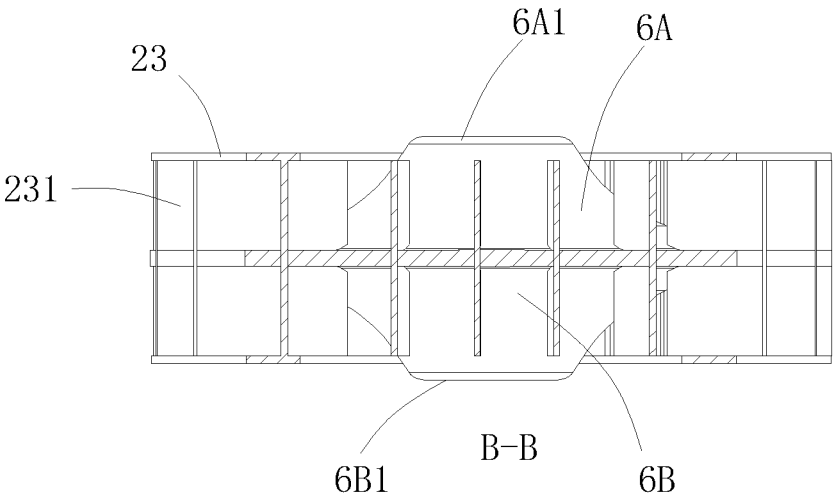
FIG. 19 is a cross-sectional view of FIG. 18.

In the following, the technical solution of the fourth embodiment of the present disclosure will be described with reference to FIGS. 16 to 19, in which FIG. 16 is a first schematic structural view of the fourth embodiment of the centrifugal fan of the present disclosure; FIG. 17 is a second schematic structural view of the fourth embodiment of the centrifugal fan of the present disclosure; FIG. 18 is a schematic structural view of the impeller of the fourth embodiment of the centrifugal fan of the present disclosure; and FIG. 19 is a cross-sectional view of FIG. 18.

As shown in FIG. 16 and FIG. 17, the centrifugal fan of this embodiment includes a housing 1, as well as an impeller 2 and volute tongues 3 that are arranged in the housing 1. The housing 1 is provided with air inlets 4 and an air outlet 5. The volute tongues 3 include a first volute tongue 31 and a second volute tongue 32 that are stacked and offset from each other. The impeller 2 is a single-layer impeller which includes an impeller portion 23 corresponding to the first volute tongue 31 and the second volute tongue 32, and the impeller portion 23 includes a plurality of vanes 231 arranged annularly, which are collectively arranged to be capable of guiding air entering the housing 1 from the air inlets 4 to the first volute tongue 31 and the second volute tongue 32 when the impeller portion 23 rotates either in the forward direction or in the reverse direction. The number of the air inlets 4 is two, and the air inlets 4 include a first air inlet 41 and a second air inlet (not shown in the figures). The first air inlet 41 and the second air inlet are respectively provided on both sides of the housing 1, the first air inlet 41 may be provided on the top plate 11 of the housing 1, and the second air inlet may be provided on the bottom plate 12 of the housing 1. The first volute tongue 31 is arranged at an upper part of the left-side plate 13 of the housing 1, that is, arranged close to the top plate 11, and the second volute tongue 32 is arranged at a lower part of the right-side plate 14 of the housing 1, that is, arranged close to the bottom plate 12. When the impeller 2 is rotating in the forward direction (rotating clockwise when viewed from the figure), the first volute tongue 31 can cut the air blown from an upper half of the impeller portion 23 and guide the air to the air outlet 5, and when the impeller 2 is rotating in the reverse direction (rotating counterclockwise when viewed from the figure), the second volute tongue 32 can cut the air blown from a lower half of the impeller portion 23 and guide the air to the air outlet 5.

It should be noted that in a case where two air inlets 4 are provided, an output shaft of a driving motor (not shown in the figure) used to drive the impeller 2 to rotate may extend from the first air inlet 41 or the second air inlet so as to be connected connect with the impeller 2. If the output shaft of the driving motor extends from the first air inlet 41, it is necessary to set a gap between the driving motor and the first air inlet 41 to avoid impeding the air from entering the housing 1 from the first air inlet 41. Similarly, if the output shaft of the driving motor extends from the second air inlet, it is necessary to set a gap between the driving motor and the second air inlet to avoid impeding the air from entering the housing 1 from the second air inlet.

Preferably, as shown in FIG. 17, the plurality of vanes 231 are all straight vanes and are arranged in the radial direction of the single-layer impeller. Through such an arrangement, the centrifugal fan can blow out the same amount of air when the impeller 2 rotates either in the forward direction or in the reverse direction. Of course, the vanes 231 may also be set to form a specific angle with the radial direction of the single-layer impeller, or the vanes 231 may be configured into other shapes. For example, the vanes 231 may be provided as arc-shaped vanes, "V"-shaped vanes or "L"-shaped vanes, etc. Such flexible adjustments and changes do not deviate from the principle and scope of the present disclosure, and should be defined within the scope of protection of the present disclosure.

Preferably, as shown in FIGS. 16 to 19, an air guiding structure 6 is provided in the impeller 2, and the air guiding structure 6 is arranged to be capable of guiding the air entering the housing 1. The air guiding structure 6 includes a first air guiding frustum 6A and a second air guiding frustum 6B that are connected, with a cone end 6A1 of the first air guiding frustum 6A being arranged close to the first air inlet 41, and a cone end 6B1 of the second air guiding frustum 6B being arranged close to the second air inlet 42. The air enters from the first air inlet 41 and then flows to an upper half of the impeller portion 23 under the guidance of the first air guiding frustum 6A, and the air enters from the second air inlet and then flows to a lower half of the impeller portion 23 under the guidance of the second air guiding frustum 6B. Of course, the air guiding structure 6 may also be provided as other air guiding structures such as two triangular pyramids connected. Such adjustments and changes to the specific structural form of the air guiding structure 6 do not deviate from the principle and scope of the present disclosure, and should be defined within the scope of protection of the present disclosure.

Finally, the present disclosure also provides a dryer, which includes the centrifugal fan of the first embodiment, the second embodiment, the third embodiment or the fourth embodiment.

Hitherto, the technical solutions of the present disclosure have been described in conjunction with the preferred embodiments shown in the accompanying drawings, but it is easily understood by those skilled in the art that the scope of protection of the present disclosure is obviously not limited to these specific embodiments. Without departing from the principles of the present disclosure, those skilled in the art can make equivalent changes or replacements to relevant technical features, and all the technical solutions after these changes or replacements will fall within the scope of protection of the present disclosure.

What is claimed is:

1. A centrifugal fan, comprising: a housing, and an impeller and volute tongues that are arranged in the housing, wherein the housing is provided with an air inlet and an air outlet, the volute tongues comprise a first volute tongue and a second volute tongue that are stacked and offset from each other, and the impeller is arranged to be capable of suctioning air into the housing from the air inlet when rotating; and wherein the first volute tongue is arranged to be capable of cutting the air blown from the impeller and guiding the air to the air outlet when the impeller is rotating in a forward direction, and the second volute tongue is arranged to be capable of cutting the air blown from the impeller and guiding the air to the air outlet when the impeller is rotating in a reverse direction.

2. The centrifugal fan according to claim 1, wherein the impeller is a double-layer impeller which comprises a first-layer impeller portion corresponding to the first volute tongue and a second-layer impeller portion corresponding to the second volute tongue, an axis of the first-layer impeller portion coinciding with an axis of the second-layer impeller portion.

3. The centrifugal fan according to claim 2, wherein the first-layer impeller portion comprises a plurality of first vanes arranged annularly, which are collectively arranged to be capable of guiding air entering the housing from the air inlet to the first volute tongue when the first-layer impeller portion is rotating in the forward direction; and the second-layer impeller portion comprises a plurality of second vanes arranged annularly, which are collectively arranged to be capable of guiding the air entering the housing from the air inlet to the second volute tongue when the second-layer impeller portion is rotating in the reverse direction.

4. The centrifugal fan according to claim 3, wherein the first vanes and the second vanes are all arc-shaped vanes, and an inclination direction of the first vanes is different from an inclination direction of the second vanes.

5. The centrifugal fan according to claim 3, wherein the first vanes and the second vanes are all straight vanes, and an inclination direction of the first vanes is the same as or different from an inclination direction of the second vanes.

6. The centrifugal fan according to claim 1, wherein the impeller is a single-layer impeller which comprises an impeller portion corresponding to the first volute tongue and the second volute tongue, and the impeller portion comprises a plurality of vanes arranged annularly, which are collectively arranged to be capable of guiding air entering the housing from the air inlet to the first volute tongue and the second volute tongue when the impeller portion rotates either in the forward direction or in the reverse direction.

7. The centrifugal fan according to claim 6, wherein the plurality of vanes are all straight vanes and are arranged in a radial direction of the single-layer impeller.

8. The centrifugal fan according to claim 1, wherein the number of the air inlet is one, and the air inlet is provided on one side of the housing.

9. The centrifugal fan according to claim 8, wherein an air guiding structure is provided in the impeller, and the air guiding structure is arranged to be capable of guiding the air entering the housing.

10. The centrifugal fan according to claim 9, wherein the air guiding structure is an air guiding frustum, and a cone end of the air guiding frustum is arranged close to the air inlet.

11. The centrifugal fan according to claim 1, wherein the number of the air inlet is two, and the air inlets comprise a first air inlet and a second air inlet which are respectively arranged on both sides of the housing.

12. The centrifugal fan according to claim 11, wherein an air guiding structure is provided in the impeller, and the air guiding structure is arranged to be capable of guiding the air entering the housing.

13. The centrifugal fan according to claim 12, wherein the air guiding structure comprises a first air guiding frustum and a second air guiding frustum that are connected, a cone end of the first air guiding frustum is arranged close to the first air inlet, and a cone end of the second air guiding frustum is arranged close to the second air inlet.

14. A dryer, comprising the centrifugal fan according to claim 1.

* * * * *